US007914249B2

(12) United States Patent
Maynard et al.

(10) Patent No.: US 7,914,249 B2
(45) Date of Patent: Mar. 29, 2011

(54) SHOVELING APPARATUS WITH MULTI-POSITIONAL SHOVEL

(75) Inventors: James R Maynard, Belfry, KY (US); Jimmy L Brock, Belfry, KY (US)

(73) Assignee: Massey European Sales, Inc., Richmond, VA (US)

( * ) Notice: Subject to any disclaimer, the term of this patent is extended or adjusted under 35 U.S.C. 154(b) by 0 days.

(21) Appl. No.: 12/369,765

(22) Filed: Feb. 12, 2009

(65) Prior Publication Data

US 2010/0201180 A1 Aug. 12, 2010

(51) Int. Cl.
*B66C 23/00* (2006.01)

(52) U.S. Cl. ..... 414/686; 414/685

(58) Field of Classification Search ..... 414/680, 414/685, 917, 686; 37/415, 416, 466
See application file for complete search history.

(56) References Cited

U.S. PATENT DOCUMENTS 4,147,263 A * 4/1979 Frederick et al. ..... 414/718
* cited by examiner

*Primary Examiner* — Donald Underwood
(74) *Attorney, Agent, or Firm* — Dinsmore & Shohl LLP; Monika J. Hussell

(57) ABSTRACT

A shoveling apparatus including a low profile vehicle, a boom assembly, and a shovel assembly for use in underground mining operations, and particularly useful in clearing coal and rock debris from a belt line corridor. The low profile vehicle includes an advanceable support that supports the boom assembly and laterally advances the boom assembly from the cab portion of the vehicle. The boom assembly includes a support structure, a rotary actuator and a linear actuator, to control lateral and vertical rotation of the support structure (and thus the shovel assembly) with respect to a ground surface. The shovel assembly includes a rotary actuator and a shovel, and in some embodiments a tilting mechanism, to control the lateral and in some cases vertical, rotation of the shovel with respect to the boom assembly.

15 Claims, 7 Drawing Sheets

SHOVELING APPARATUS WITH MULTI-POSITIONAL SHOVEL

BACKGROUND

The present invention relates generally to shoveling apparatuses with multi-positional shovels, suitable for use in underground coal mines, and designed and configured for specific use in corridors that house coal conveyor belt lines.

Coal conveyor belt lines transport coal from the mine face to a tipple or other location, and generally run the length(s) of a mine, through narrow corridors. These corridors are separate from, and generally parallel to, transportation routes within the mine. A plurality of panels run perpendicular to the transportation routes, to provide access to the belt line corridors.

From time to time coal falls from the belt line, onto the corridor floor. Furthermore, the walls of these corridors deteriorate over time, so that loose rock gathers with the fallen coal on the corridor floor. The accumulating coal and rock in the belt line corridor causes a fire hazard and creates a potentially explosive environment. Therefore, for mine safety, loose coal and rock debris must be periodically removed from the belt line corridor floor. Presently, this accumulating debris is removed by manually shoveling it onto the belt line, which is generally hazardous, costly, and time consuming. The belt line may be over four feet above the ground, making the manual task of cleaning belt line corridors even more demanding. However, there exists no known vehicle or other mechanical device suitable for removing coal and rock debris from the corridor floor and moving it to the belt line.

Thus, an object of the present invention is to provide a mechanical apparatus to shovel coal and other debris from the belt line corridor floor (including under the belt line), moving it to the belt line, for removal from the mine. Other objects and purposes of the present invention will become apparent to those skilled in the art from the following description, wherein there is shown and described preferred embodiments of this invention.

SUMMARY

The shoveling apparatus of the present invention comprises a low profile vehicle, a boom assembly, and a shovel assembly, wherein the boom assembly is capable of positioning the shovel assembly into a belt line corridor so that coal and debris therein may be collected and transported to the belt line for further conveyance by the belt line out of the mine.

The low profile vehicle generally comprises a cab portion, at least one motive support, and an advanceable support. The cab portion provides a workspace in the vehicle for an operator of the shoveling apparatus; the motive support (e.g., continuous tracks, wheels) mobilizes the low profile vehicle; and the advanceable support supports and advances the boom assembly from the cab portion.

The boom assembly generally comprises a rotary actuator, a linear actuator, and an elongated support structure, wherein the rotary actuator laterally rotates this elongated support structure 90, in each direction, with respect to the advanceable support of the low profile vehicle; the linear actuator vertically rotates the structure relative to the advanceable support; and the elongated support structure supports and positions the shovel assembly with respect to a ground surface (the elongated support structure may further contain tubing, wires, and/or other power and communication components). The boom assembly is affixed to and supported by the advanceable support.

The shovel assembly generally comprises a shovel assembly rotary actuator, a shovel, and in some embodiments a tilting mechanism, wherein this rotary actuator laterally rotates the shovel up to 90°, in each direction, with respect to the elongated support structure of the boom assembly; the shovel facilitates shoveling and moving of a material; and the tilting mechanism vertically tilts the shovel with respect to the shovel assembly rotary actuator. The shovel assembly may further comprise an advanceable plate that facilitates removal of the material from the shovel. The shovel assembly is affixed to and supported by the boom assembly.

The present invention thereby moves the shovel to multiple positions by one or more of: the advancement or retraction of the boom assembly by the advanceable support; the lateral rotation of the boom assembly elongated support structure by the boom assembly rotary actuator; the vertical rotation of the boom assembly elongated support structure by the boom assembly linear actuator; the lateral rotation of the shovel by the shovel assembly rotary actuator; and the vertical tilting of the shovel by the tilting mechanism, so as to facilitate shoveling, carrying, and dumping of the material by the shoveling apparatus, in belt corridors and similar difficult to reach areas in locations such as underground coal mines.

BRIEF DESCRIPTION OF THE DRAWINGS

The following detailed description of specific embodiments can be best understood when read in conjunction with the following drawings, where like structure is indicated with like reference numerals and in which.

Figure 1:
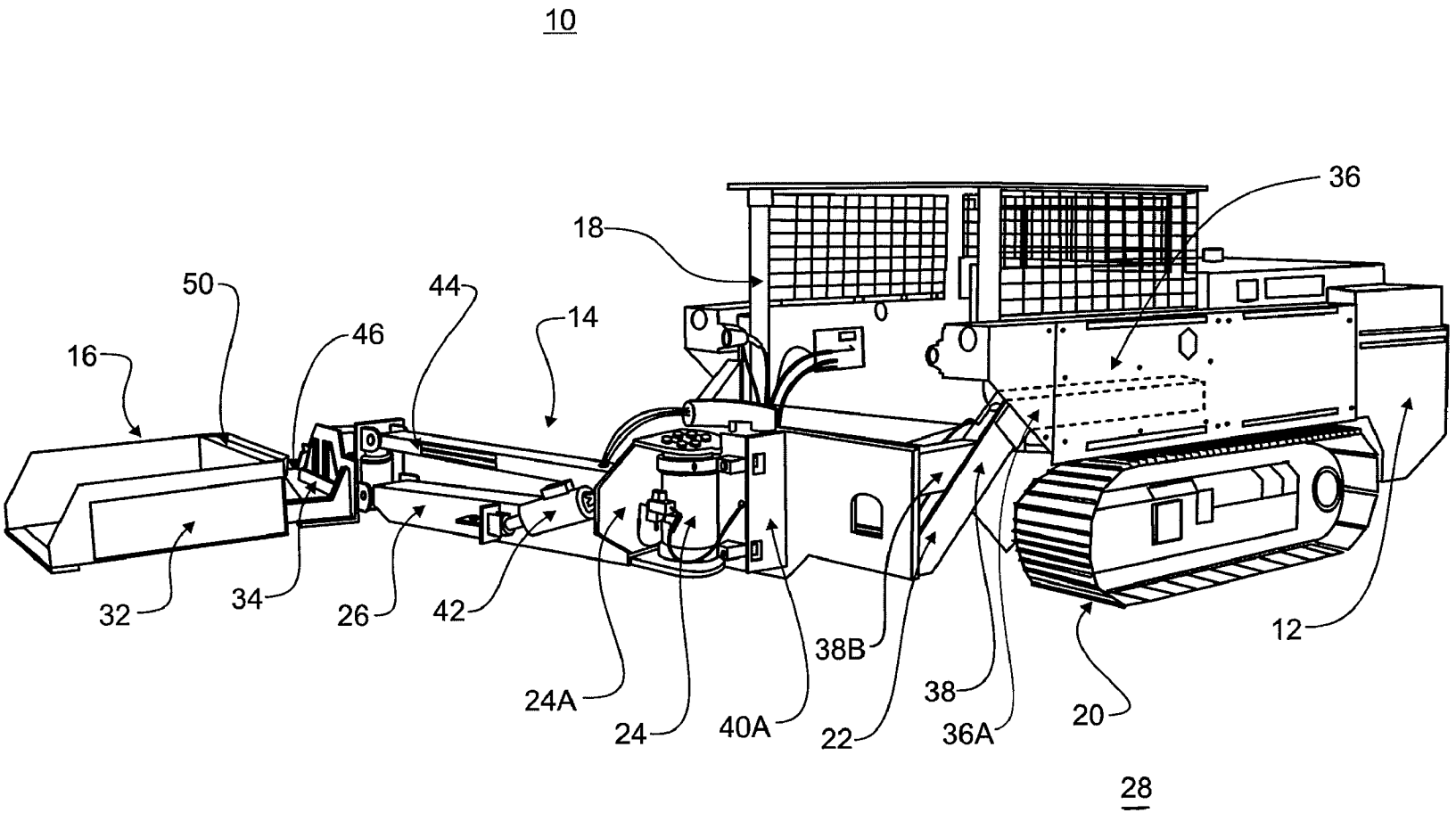
FIG. 1 is a perspective view of a shoveling apparatus according to one embodiment.

The embodiments set forth in the drawings are illustrative in nature and are not intended to be limiting of the embodiments defined by the claims. Moreover, individual aspects of the drawings and the embodiments will be more fully apparent and understood in view of the detailed description.

DETAILED DESCRIPTION

Referring initially to FIG. 1, embodiments of a shoveling apparatus 10 respectively comprise a low profile vehicle 12, a boom assembly 14, and a shovel assembly 16. These components 12, 14, 16 of the shoveling apparatus 10 cooperate to shovel coal and rock from around and under coal belts in underground coal mines, and dump the debris onto the coal belts for conveyance out of the mines.

Figure 2:
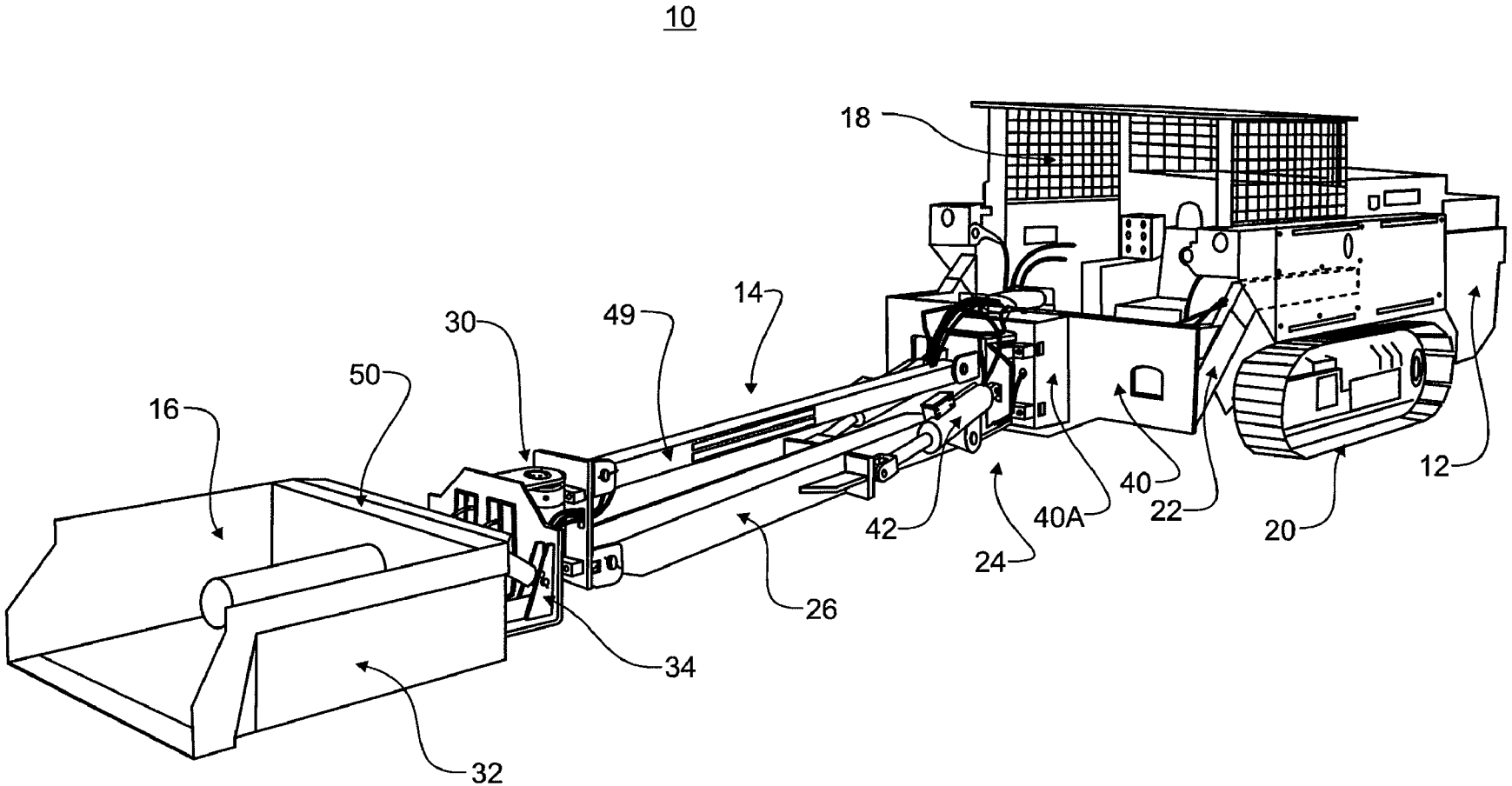
FIG. 2 is a perspective view of the embodiment of the shoveling apparatus shown in FIG. 1.
Figure 3:
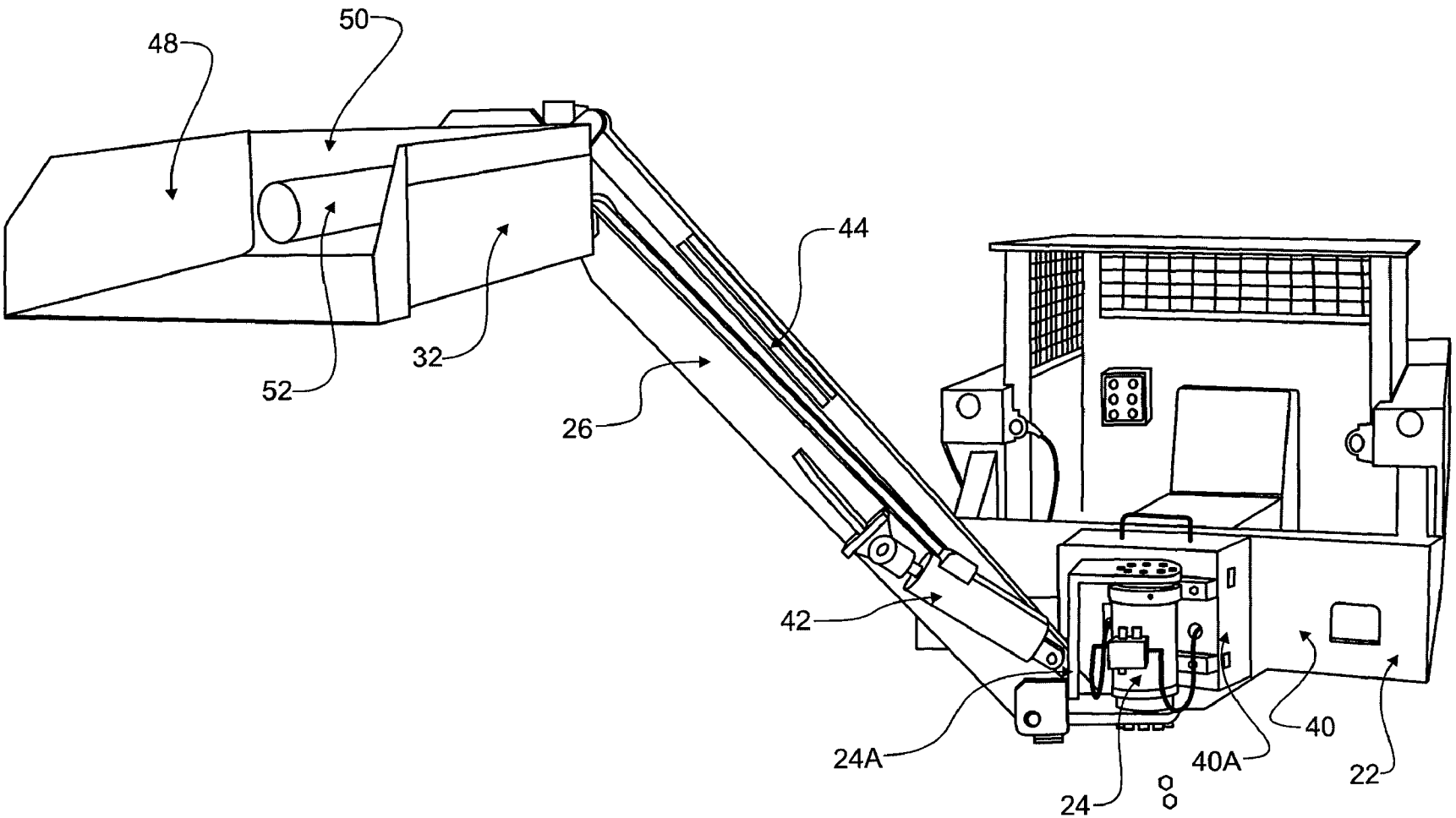
FIG. 3 is a perspective view of the embodiment of the shoveling apparatus shown in FIG. 1.

As shown in FIGS. 1-3, the low profile vehicle 12 comprises a cab portion 18, one or more motive supports 20, and an advanceable support 22. The cab portion 18 provides a workspace in the vehicle 12 for an operator of the shoveling apparatus, and generally comprises a cage, or other protective enclosure or partial enclosure, to provide some protection to the operator from foreign objects that may fall onto the vehicle. Generally, the low profile vehicle 12, the boom assembly 14, and the shovel assembly 16 are controllable by the operator from within the cab portion of the vehicle. The low profile vehicle 12 may comprise a variety of dimensions (remaining cognizant of the height and maneuverability restrictions within underground mines). In one exemplary embodiment, the low profile vehicle comprises a length of 9'-11', preferably about 10'5", and a height of 3'-5', preferably about 4'3".

The motive supports 20 mobilize the low profile vehicle 12 and generally provide sufficient ground clearance for the vehicle to travel over rocky and/or uneven terrain. For example, in one embodiment, the motive supports provide a ground clearance of about 12". The motive support(s) 20 may be configured as one or more continuous tracks, wheels, or other supportive devices, or combinations thereof, causing, or having potential to cause, motion of the low profile vehicle 12.

The advanceable support 22 of the low profile vehicle 12 supports the boom assembly 14, as shown in FIGS. 1-3, 5 and 6. As used herein, "advanceable" simply refers to an ability to longitudinally advance from a position closer to the vehicle to a position further from the vehicle. This longitudinal advancing of the boom assembly 14 from the cab portion 18 by the advanceable support 22 is variable to any feasible distance. For example, but not by way of limitation, the advanceable support 22 may advance the boom assembly 14 a variable distance up to about 4' from the cab portion 18. Preferably, the advanceable support permits at least 1'-3' advancement, to further the reach of the shovel assembly 16 into the belt corridor.

Figure 5:
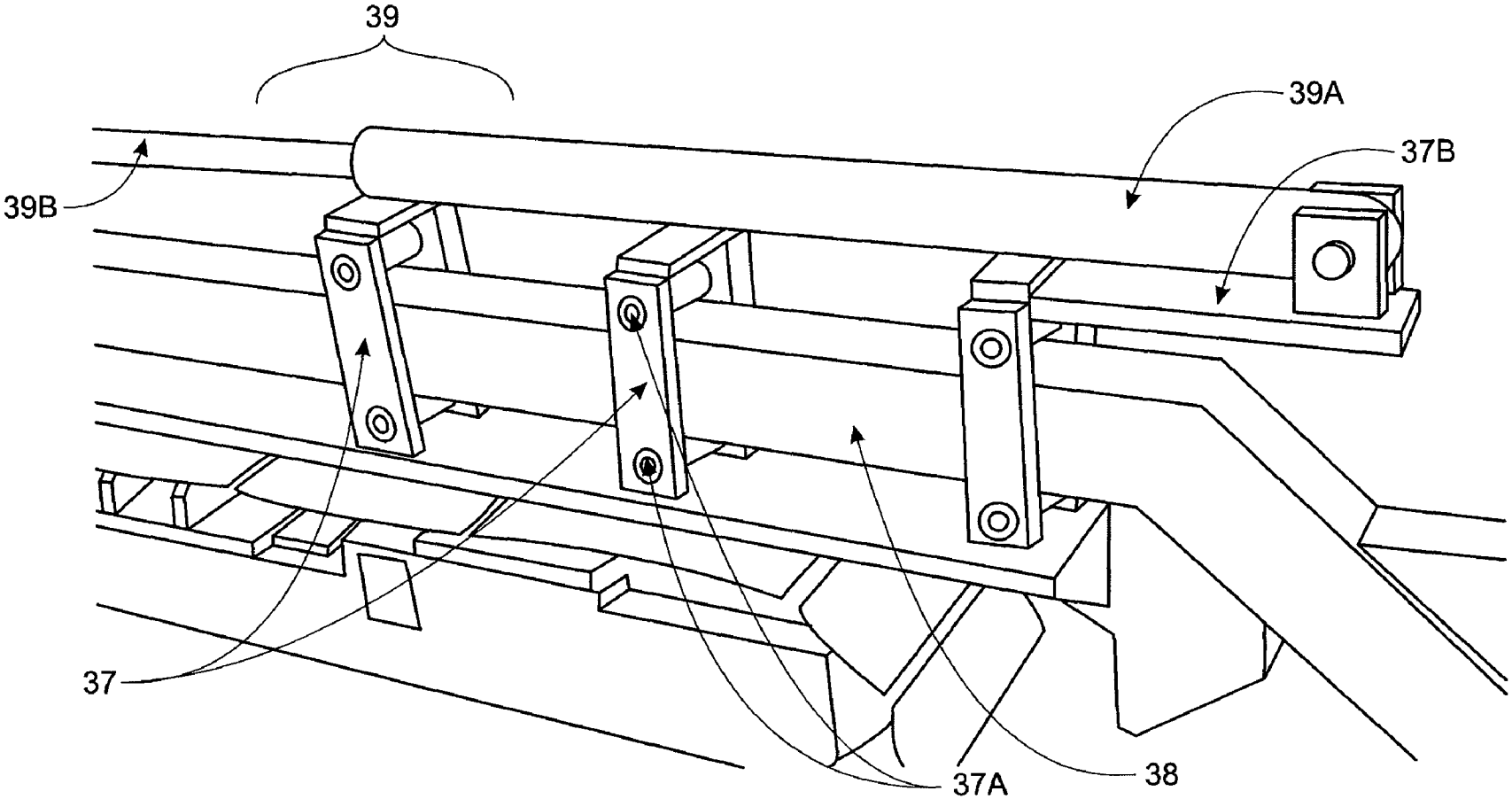
FIG. 5 is a partial view of components of the advanceable support of an embodiment of a shoveling apparatus.

As shown in FIG. 5, generally the advanceable support 22 comprises an elongated support structure and one or more receptacles 37 partially receiving, supporting and promoting longitudinal movement of the support structure. In the embodiment shown in the FIGs, the elongated support structure comprises parallel arms 38 that laterally advance from, and retract to, corresponding cavities 36 on the sides of the low profile vehicle 12 by means of an opening 36A on each side of the vehicle. The exposed ends of the parallel arms 38 preferably extend at an angle toward the ground surface 28, and terminate at a face plate 40, which is substantially perpendicular to the ground surface. For additional support, these exposed ends preferably flare out on at least one edge, at an angle, so that the width of the exposed end is about the height of the plate 40; alternatively, an additional support structure 38B may further adjoin the arm 38 to the plate 40. The interior ends of the parallel arms 38 remain within the cavities 36 when fully assembled and during operation. In some embodiments, the parallel arms 38 are constructed from 3" ×6" rectangular tubing, having ½" thick walls, and a length of between 3' and 10', preferably between 5' and 8', so that, when the advanceable support is assembled, it supports the extension thereof by a preferred distance of 3' from the forward-most end of the cavity 36 or the cab portion 18. In the embodiment shown, the barrel 39A of the cylinder is 3' long; therefore, to promote such extension, the arms 38 must be at least 6' long.

As shown in the embodiment of FIGS. 1 and 5, each cavity 36 provides exterior walls to protect components therewithin, with a sufficient opening to allow advancement of the parallel arm 38. Generally, one or more receptacles 37 are positioned within the cavity, to receive, support and promote the advancement and retraction of the parallel arm 38. In the embodiment shown in FIG. 5, three receptacles are positioned within a cavity 36, with each receptacle having two rollers 37A affixed thereto and positioned to receive the parallel arm 38 therebetween.

The longitudinal advancement and retraction of the advanceable support 22 may be performed by any conventional devices, such as, but not limited to, linear actuators, gears, chains, actuators, belts, and/or other mechanical and/or electrical devices, or combinations thereof. In a preferred embodiment, as depicted in FIG. 5, hydraulic cylinder systems 39 are used to control the longitudinal advancement and contraction of the parallel arms 38, with the clevis of each hydraulic cylinder (extending from and affixed to the exposed end of the cylinder rod 39B) being affixed to or engaged with the interior end (opposite from the exposed end) of a parallel arm 38, so that when the cylinder rod 39B is fully extended from the barrel 39A of the hydraulic cylinder, the parallel arm is retracted within the cavity 36 (with a portion of the parallel arm, and the face plate 40, remaining outside of the cavity); as the cylinder rod is contracted by traditional means of the hydraulic cylinder system, the parallel arm 38 is advanced from the cavity until in its fully extended position (with a portion of the parallel arm remaining within the cavity). In some embodiments (as shown in FIG. 5), the barrel 39A of the hydraulic cylinder system 39 is affixed to the top of a receptacle 37, with a plate 37B extending from the outermost receptacle, within the cavity, to provide additional support for the cylinder barrel 39A. The advanceable support 22, as such, longitudinally advances and retracts the boom assembly 14 from/toward the cab portion 18.

The boom assembly 14, an embodiment of which is shown in FIGS. 1-4, 6 and 7, couples the shovel assembly 16 to the low profile vehicle 12, and generally comprises a rotary actuator 24 and an elongated support structure. In the embodiment shown, the boom assembly elongated support structure comprises a positioning arm 26 and a leveling arm 44.

Figure 6:
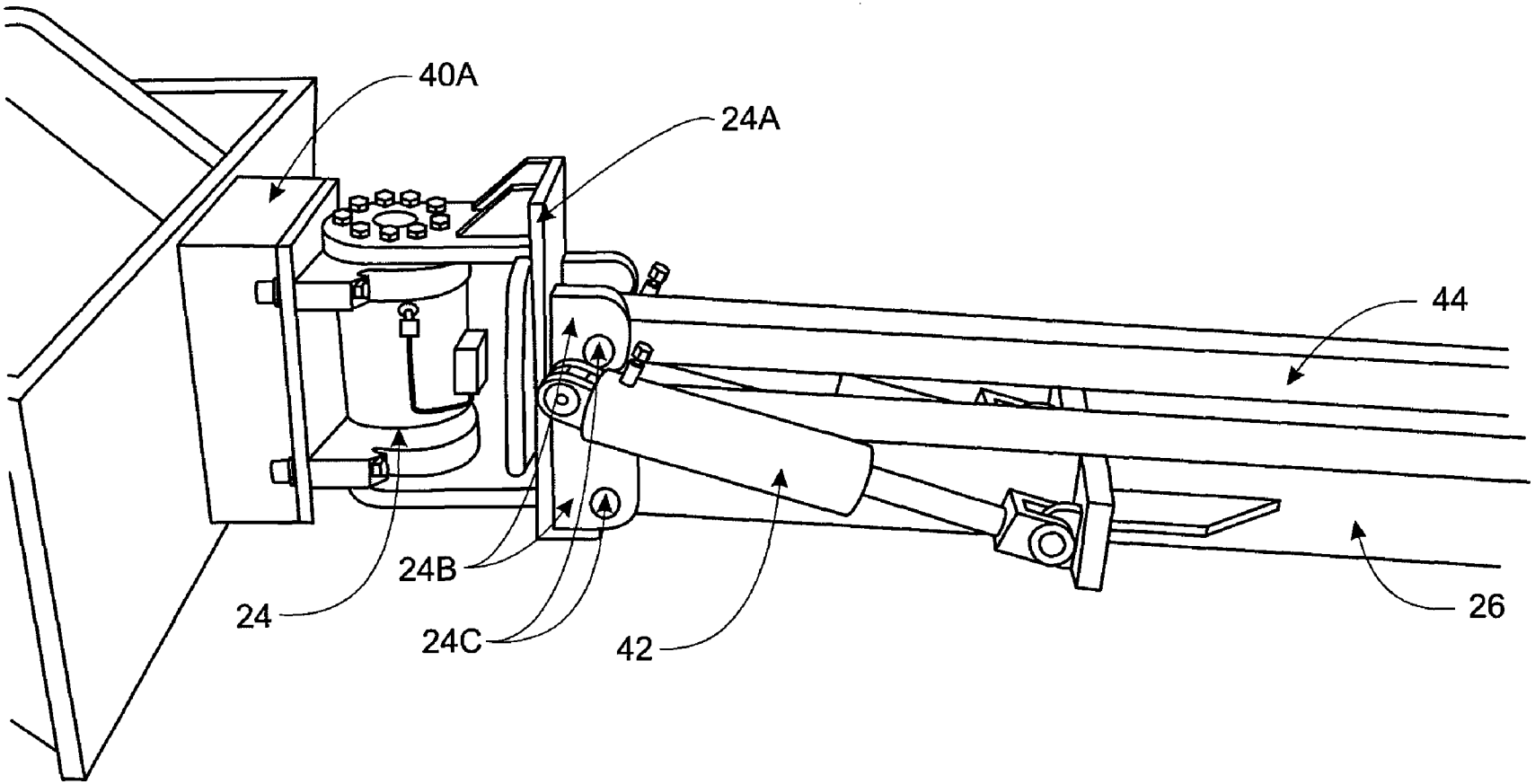
FIG. 6 is a view of portions of the advanceable support and the boom assembly of an embodiment of a shoveling apparatus.

The boom assembly rotary actuator 24 laterally rotates the boom assembly elongated support structure with respect to the advanceable support 22, up to 180° (90° in each direction). As shown in FIGS. 1, 2 and 6, in some embodiments the boom assembly rotary actuator is affixed (by its feet) to the face plate 40 of the advanceable support by a support structure 40A, which extends from the plane face of the plate. The support structure 40A is sized (and the actuator is positioned thereon) to allow the positioning and leveling arms to swing a full 90°, in either direction, without interference with the face plate 40 or the support structure 40A; preferably, the support structure is a rectangular box slightly larger than the footprint of the actuator base, with a depth of 0.5' to 1.5'. By this and other embodiments, the boom assembly rotary actuator directs and controls the rotation of the boom assembly elongated support structure laterally about the face plate 40.

As shown in FIG. 6 the positioning arm 26 and the leveling arm 44 are affixed to the rotary actuator 24 by a bracket 24A, straddle mounted on the actuator and bolted to the shaft and endcap flanges of the actuator. Each of the leveling arm 44 and the positioning arm 26 are pivotally affixed (by devises 24B, pins 24C and corresponding apertures positioned at the end of each arm) to the bracket so that, in addition to supporting the load of the arms and enabling the lateral rotation of the arms by the boom assembly rotary actuator, the arms may be vertically rotated (about the pins) as hereinafter described.

Each of the positioning arm 26 and the leveling arm 44 also rotate in the vertical plane, relative to the low profile vehicle, and about their affixation point 24C to the rotary actuator 24, to lift and lower the shovel assembly (see FIGS. 1 and 3); preferably, this rotation is caused and controlled by a linear actuator, such as a pair of boom lift cylinders 42 with load lock, as shown in the figures, or similar systems or designs to support the load of the positioning and leveling arms, the shovel assembly, and any coal and debris that may be transported by the shovel. When extended, the linear actuator positions the positioning and leveling arms so that the shovel is at the ground surface, and when fully retracted it positions the arms so that the shovel is at the highest design level (at least sufficient to deposit the coal on the coal belt, but being cognizant of limited vertical space within belt line corridors). In the embodiment shown, the boom lift cylinders 42 are affixed to the bracket 24A at the barrel end, and to the positioning arm 26 at the exposed end of the cylinder rod.

In one embodiment, the positioning arm 26 and leveling arm 44 are about 8' in length, thereby vertically positioning the shovel assembly 16 a variable distance between in contact with the ground surface 28 and about 5'3" above the ground surface. Preferably, the positioning arm has a length of between 6' and 10', and positions the shovel to a maximum height of 4' to 7' above the ground surface 28.

The positioning arm is preferably a 6"×6", 31 lb, boxed-in beam. As shown in FIGS. 1, 2, 4 and 7, the bottom end of the positioning arm 26, nearest to the shovel assembly 16, may recede on one side so that when the shovel is near ground surface 28, the positioning arm does not inhibit the shovel from being flat on the surface of the ground to effectively shovel the coal and debris. Preferably, the leveling arm is a tubular structure having a 2"×4" cross section, with a wall thickness of ¼". It is possible, although not preferred, that the positioning and leveling arms are a single arm or structure sufficient to support the shovel and any coal and rock it shovels, carries and delivers to a belt line.

Figure 7:
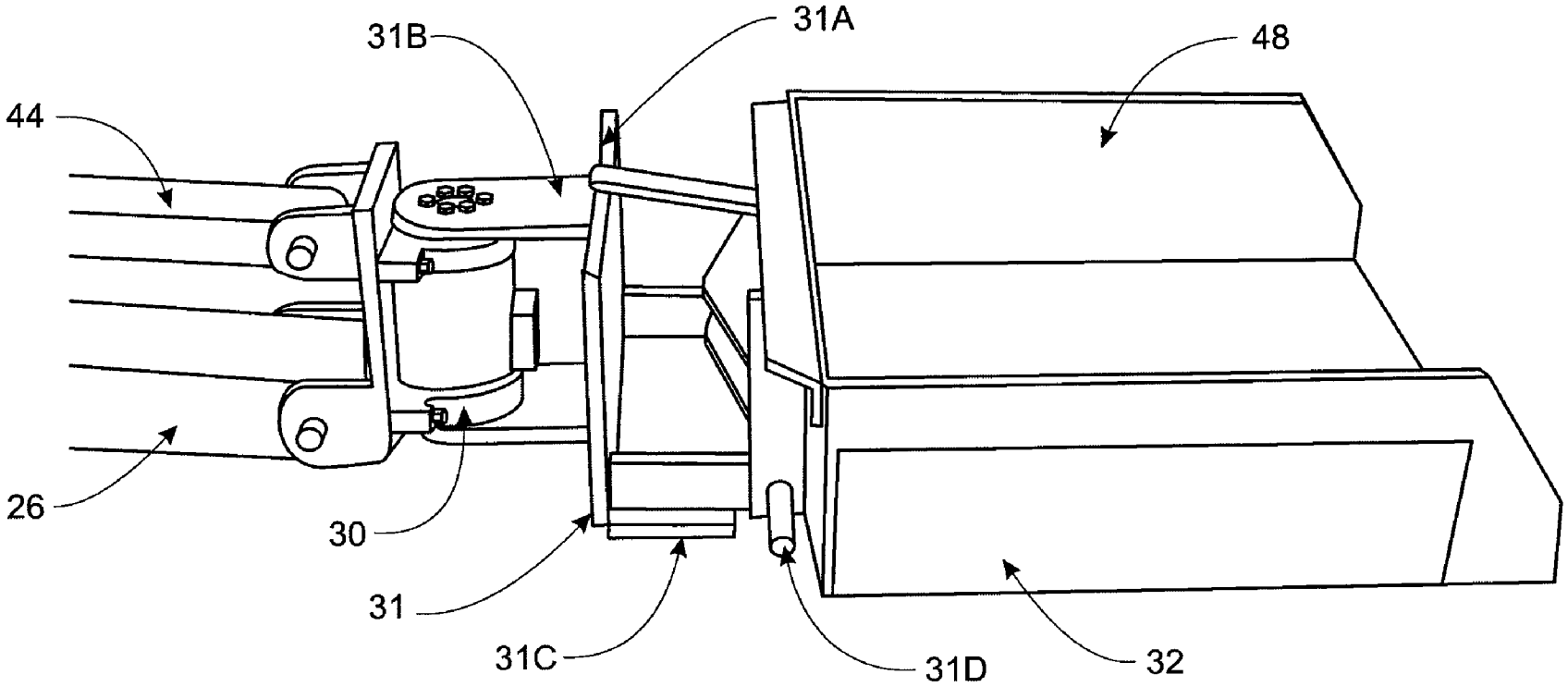
FIG. 7 is a view of portions of the boom assembly and the shovel assembly of an embodiment of a shoveling apparatus.

The shovel assembly 16, shown in FIGS. 1-4 and 7, comprises a rotary actuator 30, a shovel 32, and a tilting mechanism 34. The shovel assembly rotary actuator 30 laterally rotates the shovel 32 up to 90°, in each direction, with respect to the boom assembly elongated support structure. A plate 30A facilitates the affixation of the boom assembly elongated support structure (pivotally affixed thereto by pins and clevices) to the shovel assembly rotary actuator 30 (affixed at the feet to said plate), as shown in FIGS. 1, 2 and 7. Thus, the positioning and leveling arms can pivot as they rotate vertically about the pins 24B, while the shovel assembly rotary actuator remains in a stable, horizontal position.

Figure 4:
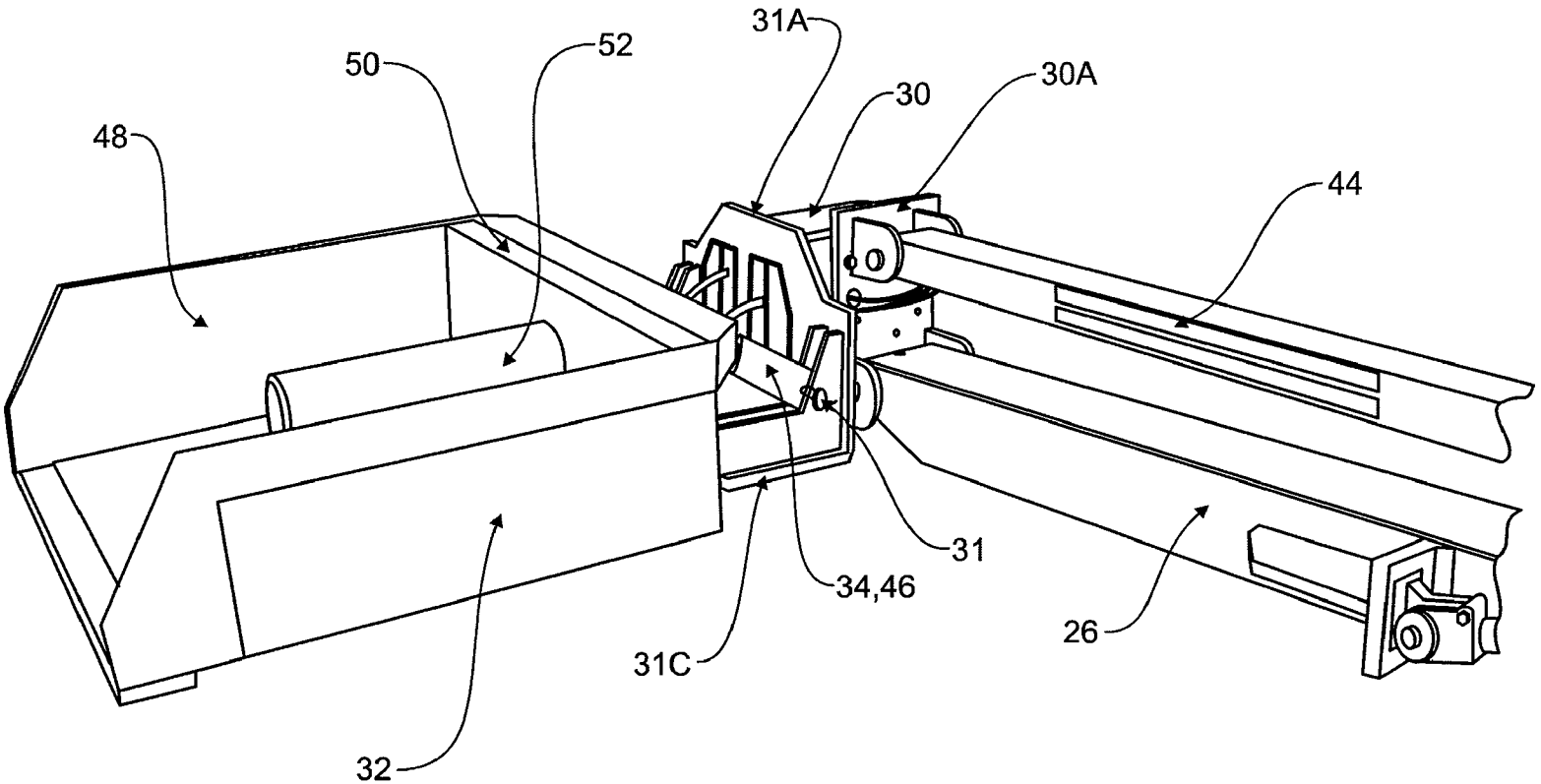
FIG. 4 is a magnified, perspective view of a shovel assembly of an embodiment of the shoveling apparatus.

As shown in FIGS. 4 and 7, the shovel is affixed to the shovel assembly rotary actuator by a support structure 31. This support structure 31 comprises a plate 31A, from which a bracket 31B protrudes to the back to allow the same to straddle mount the actuator 30. At the bottom, and protruding perpendicularly from the plate, is a support surface or plate 31C which rotationally affixes to the back of the shovel, with pins 31D and devises or other hinging apparatus (thereby allowing the plate to tilt, as hereinafter described).

Tilting of the shovel with respect to the shovel assembly rotary actuator is controlled by one or more linear actuators, preferably hydraulic cylinder systems 46, each engaged on opposite sides with the top half of the back side of the shovel 32 and the bottom half of the supporting structure 31. When the rods extend from the barrels of these systems, the shovel tilts downwards; when they are retracted the shovel resumes its normal position (lateral to the surface, or tilted upwards). Thus the shovel 32 can tilt to assist in the capturing and holding coal therein, and removal of coal therefrom.

By virtue of the shovel's depth dimension and side and back walls, the shovel 32 generally comprises a cavity 48 in which the material may be held until its removal from the shovel 32. Generally, the material is dumped from the shovel 32 through a downward tilting of the shovel via the tilting mechanism 34, as described above. Alternatively, or in addition thereto, the material may be pushed from the cavity 48 of the shovel 32 by an advanceable plate 50, as depicted in FIG. 4, or other similarly performing device. The advanceable plate 50 generally is perpendicular to, or at least angular to, a bottom of the cavity 48 and is advanceable at least partially, but preferably substantially, across the cavity 48, from the back plate to the open front of the shovel. Thereby, the advanceable plate 50 may directionally push the material in the cavity 48 with advancement of the advanceable plate 50 at least partially across the cavity 48. The advancement and retraction of the advanceable plate 50 across the cavity 48 of the shovel 32 is controlled by means such as a hydraulic ram jack, stored and protected by rod 52

The shovel 32 may comprise any variety of dimensions suitable for shoveling, carrying, and/or dumping the material in the limited space of a belt line corridor. For example, the shovel 32 comprises a length and width of between 2'-4', respectively, and a depth of between 0.5' and 2'. More preferably, the width and height range from 2.5'-3.5', and the depth is about 1'.

By the present invention, the shovel 32 is positionable in multiple positions with respect to the cab portion 18 of the low profile vehicle (and therefore capable of reaching into and working within the belt line corridors, to mechanically collect fallen coal and rock debris, and deliver the same to the belt line). More particularly, the shovel 32 is positionable via one or more of the lateral advancement and/or retraction of the boom assembly 14 by the advanceable support 22, the bi-directional lateral rotation of the positioning and leveling arms 26 and 44 by the boom assembly rotary actuator 24, the bi-directional vertical positioning of the shovel assembly 16 by the boom assembly linear actuator 42, the bi-directional lateral rotation of the shovel 32 by the shovel assembly rotary actuator 30, and the bi-directional vertical tilting of the shovel 32 by the tilting mechanism 34. This variability in the positioning of the shovel 32 enhances operational capabilities of the shoveling apparatus 10 in reaching difficult to reach areas, and facilitates shoveling, carrying, and/or dumping of material by the shoveling apparatus 10.

While hydraulic cylinders and actuators are preferred in the apparatus of the present invention, other structures such as pneumatic pumps, or other linearly or rotary motive devices may be suitable for use in the present invention. Specifically suitable for use in the present invention is a helical, hydraulic rotary actuator from Helac Corporation (series L30).

It is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural characteristics of the component.

It is noted that terms like "generally," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the term "substantially" and "partially" are utilized herein to represent the inherent degree of uncertainty that may be attributed to any quantitative comparison, value, measurement, or other representation. The terms "substantially" and "partially" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed is:

1. A shoveling apparatus comprising:

a low profile vehicle suitable for use in underground mines, said vehicle further comprising an advanceable support structure, and one or more receptacles partially receiving and supporting longitudinal movement of said advanceable support structure;

a boom assembly;

a shovel;

first and second rotary actuators, wherein said first rotary actuator is affixed to said advanceable support structure and said boom assembly, to control horizontal rotational movement of said boom assembly about said support structure, and said second rotary actuator is affixed to said boom assembly and said shovel, to control horizontal rotational movement of said shovel about said boom assembly; and first and second linear actuators, wherein said first linear actuator is engaged with said advanceable support structure to control the longitudinal movement of the advanceable support structure, and said second linear actuator is engaged with said boom assembly to control the vertical rotational movement of the boom assembly with respect to the first rotary actuator.

2. The apparatus of claim 1, further comprising a third linear actuator engaged with said shovel to control the vertical rotation of the shovel with respect to the second rotary actuator.

3. The apparatus of claim 1, wherein said advanceable support structure has a length of between 5' and 8', and comprises a pair of parallel arms moveably positioned on opposing sides of the low profile vehicle.

4. The apparatus of claim 1, wherein said boom assembly has a length of between 6' and 10', and comprises a positioning arm and a leveling arm.

5. The apparatus of claim 1, wherein said boom assembly has a first and second end, with each end having an aperture therethrough; and wherein said first and second rotary actuators are hydraulic helical actuators, each having four feet forming a base thereof, the apparatus further comprising:

a rectangular structure affixed to and between said first rotary actuator and said advanceable support structure, with the feet of the first rotary actuator being secured to said rectangular structure;

a first bracket structure, clevises and pins, affixed to and between said first rotary actuator and said boom assembly, wherein the first bracket structure is straddle mounted on said rotary actuator, the clevises extend from said first bracket structure, and the pins extend through the aperture in the first end of the boom assembly when said end is engaged with a corresponding clevis;

a plate, clevises and pins, affixed to and between said second rotary actuator and said boom assembly, wherein the feet of the second rotary actuator are secured to said plate, the clevises extend from said plate, and the pins extend through the aperture in the second end of the boom assembly when said end is engaged with a corresponding clevis; and a second bracket structure, affixed to and between said second rotary actuator and said shovel, wherein the second bracket structure is straddle mounted on said second rotary actuator.

6. The apparatus of claim 2, wherein said first linear actuator is a hydraulic actuator, and wherein said second and third linear actuators each comprises two hydraulic cylinder systems.

7. The apparatus of claim 1, wherein the advanceable support structure comprises two parallel arms, positioned on opposing sides of the low-profile vehicle, so that each said arm has an internal end and an exposed end, a face plate affixed to the exposed ends of said parallel arms the one or more receptacles comprise at least two receptacles, each having rollers positioned therein to receive one of said parallel arms;

the vehicle further comprising opposing cavities, each cavity being positioned on corresponding sides of the vehicle to conceal and protect the respective receptacles, the first linear actuator, and a portion of the parallel arm;

the first linear actuator comprises two hydraulic cylinders, each said cylinder comprising a barrel and a cylinder rod, with each said rod being affixed to the internal end of a parallel arm, and said barrel being affixed to at least one of said receptacles.

8. The apparatus of claim 7, wherein each of the parallel arms, at the exposed end thereof, angle away from the longitudinal axis of the vehicle.

9. The apparatus of claim 1, wherein the shovel is defined in part by a cavity, and further comprises a moveable plate positioned in said cavity, a jack coupled to said plate, and a rod protruding from said plate and concealing said jack.

10. A shoveling apparatus comprising:

a low profile vehicle suitable for use in underground mines, said vehicle further comprising a pair of parallel arms positioned on opposing sides of the low profile vehicle, each arm having an internal end and an exposed end, at least two receptacles, each having rollers positioned thereon, wherein each of said receptacles partially receive and said rollers support longitudinal movement of one of said parallel arms, a face plate affixed to the exposed ends of said parallel arms, and opposing cavities, each positioned to conceal the respective receptacles and a portion of the parallel arm, on a side of the vehicle;

a positioning arm and a leveling arm;

a shovel;

first and second rotary actuators, wherein said first rotary actuator is affixed to said parallel arms and said positioning and leveling arms, to control horizontal rotational movement of said positioning and leveling arms about said parallel arms; and said second rotary actuator is affixed to said positioning and leveling arms and said shovel, to control horizontal rotational movement of said shovel about said positioning and leveling arms; and first, second and third hydraulic cylinder systems, wherein said first hydraulic cylinder system comprises two hydraulic cylinders, each said cylinder comprising a barrel and a cylinder rod, with each said rod being affixed to the internal end of a parallel arm to control the longitudinal movement thereof;

said second hydraulic cylinder system is engaged with said positioning and leveling arms to control the vertical rotational movement of the positioning and leveling arms with respect to the rotary actuator; and said third hydraulic cylinder system is engaged with said shovel to control the vertical rotation of the shovel with respect to the second rotary actuator.

11. The apparatus of claim 10, wherein said parallel arms each have a length of between 5' and 8', and said positioning and leveling arms each have a length of between 6' and 10'.

12. The apparatus of claim 10, wherein said positioning and leveling arms each has a first and second end, with each end having apertures therethrough, and wherein said first and second rotary actuators are hydraulic helical actuators having feet forming a base thereof, further comprising:

a rectangular structure affixed to and between said first rotary actuator and said face plate, with the feet of the first rotary actuator being secured to said rectangular structure;

a first bracket structure, clevises and pins, affixed to and between said first rotary actuator and the positioning and leveling arms, wherein the first bracket structure is straddle mounted on said first rotary actuator, the clevises extend from said first bracket structure, and the pins extend through the apertures in the first end of the positioning and leveling arms when said ends are engaged with a corresponding clevis;

a plate, clevises and pins, affixed to and between said second rotary actuator and said positioning and leveling arms, wherein the feet of the second rotary actuator are secured to said plate, the clevises extend from said plate, and the pins extend through the apertures in the second end of the positioning and leveling arms when said ends are engaged with a corresponding clevis; and a second bracket structure, affixed to and between said second rotary actuator and said shovel, wherein the second bracket structure is straddle mounted on said second rotary actuator.

13. The apparatus of claim 10, wherein each of the parallel arms, at the exposed end thereof, angle away from the longitudinal axis of the vehicle.

14. The apparatus of claim 10, wherein the shovel is defined by a cavity and further comprises a moveable plate positioned in said cavity, a jack coupled to said plate, and a rod protruding from said plate and concealing said jack.

15. A method for removing coal and rock debris from the belt line corridor of an underground mine, said method comprising the steps of:

providing a shoveling apparatus comprising:

a low profile vehicle suitable for use in underground mines, said vehicle further comprising an advanceable support structure, and one or more receptacles partially receiving and supporting said advanceable support structure; and a boom assembly;

a shovel;

first and second rotary actuators, wherein said first rotary actuator is affixed to said advanceable support structure and said boom assembly, to control horizontal rotational movement of said boom assembly about said advanceable support structure; and said second rotary actuator is affixed to said boom assembly and said shovel, to control rotational movement of said shovel about said boom assembly; and a linear actuator, wherein said linear actuator is engaged with said boom assembly to control the vertical movement of the boom assembly.

positioning said apparatus near the corridor;

positioning the shovel within the corridor, at ground surface, and scooping coal and rock debris therefrom by linear movement of the parallel arms, linear and rotational movement of the boom assembly, and rotational movement of the shovel; and lifting the shovel and depositing the coal and rock debris on the belt line by linear and rotational movement of the boom assembly, and rotational movement of the shovel.

* * * * *